US007980776B2

(12) United States Patent
Cho

(10) Patent No.: US 7,980,776 B2
(45) Date of Patent: Jul. 19, 2011

(54) HEATED MASCARA

(76) Inventor: Yong Hoon Cho, Fullerton, CA (US)

( * ) Notice: Subject to any disclaimer, the term of this patent is extended or adjusted under 35 U.S.C. 154(b) by 548 days.

(21) Appl. No.: 12/231,441

(22) Filed: Sep. 3, 2008

(65) Prior Publication Data

US 2010/0054841 A1 Mar. 4, 2010

(51) Int. Cl.
*A46B 11/08* (2006.01)

(52) U.S. Cl. ..... 401/1

(58) Field of Classification Search ..... 401/1, 2
See application file for complete search history.

(56) References Cited

U.S. PATENT DOCUMENTS 7,083,347 B2 * 8/2006 Marcotte et al. ..... 401/1
7,909,044 B2 * 3/2011 Tranchant et al. ..... 132/218

* cited by examiner

*Primary Examiner* — Huyen Le
(74) *Attorney, Agent, or Firm* — Maria Erlinda Co Sarno

(57) ABSTRACT

A heated mascara device having a mascara container housing a mascara formulation and a mascara applicator having an applicator head control heated by a heating system, the heating system turning on when the mascara applicator is disengaged from the mascara container and turning off when the mascara applicator is engaged with the mascara container. The applicator head has two sets of lined tooth protruding from a casing of the applicator head, a first set of a single combing toothed strip for combing the eyelashes and a second set of a plurality of lined applicator toothed strips for applying the mascara to the eyelashes.

21 Claims, 6 Drawing Sheets

HEATED MASCARA

The present invention relates to a heated mascara applicator. Applying heat to the mascara as it is applied to the eyelashes alters the viscosity of the mascara in a controlled manner, allowing the mascara to be manipulated at the time of use, for improved results.

BACKGROUND

A significant part of a ladies' make-up is the use of mascara to accentuate the eye and the eyelashes. The common usage is either to first curl the eyelashes and then apply the mascara or apply the mascara and then curl the eyelashes with a heated eyelash curler. It would be preferable to have a device where the two steps can be performed in a single step. A heated mascara applicator with a special type of applicator head will provide the benefit of combining the application and the curling of the eyelashes into a single step.

The success on the use of the mascara product depends upon the use of the right applicator. Mascara formulations are heavy, viscous, sticky, and often messy when applied. It also dries out quickly at ambient temperature. These characteristics make it difficult to apply the mascara to the eyelashes because the latter has a small target area and are soft, flexible, delicate and in close proximity to the sensitive eye tissue. Heating the mascara formulation at a controlled level will reduce the viscosity of the formulation and allow this to be applied easily and quickly to the eyelashes. For a more even and beautiful look, the applicator can have a comb section for separating the eyelashes that may have clamped together after the mascara application as well as remove excess formulation on the eyelashes. Since the formulation dries out quickly, it would be beneficial to have the heating element immediately shut off as soon as the application is finished. Further, to cut cost by reusing the mascara applicator, the mascara container containing the formulation into which the applicator inserts into is preferably replaceable or reusable.

It is an object of this invention to provide a heated mascara applicator that will heat the mascara formulation only during usage to prevent unnecessary dry out of the mascara formulation while making it less viscous for ease of application.

It is also an object of this application to provide an applicator that will curl the eyelashes while the mascara formulation is being applied.

It is a further object of this application to provide a heated mascara applicator device with a reusable or replaceable mascara container.

It is still a further object of the invention to provide an applicator with an applicator head comprising a comb section and an applicator section.

It is also a further object of this invention to provide a heated mascara applicator having an applicator head heated to a controlled level so as not to burn the user or the eyelashes.

BRIEF DESCRIPTION OF THE DRAWING

Aspects of the present invention are illustrated by way of example, and not by way of limitation, in the accompanying drawings, wherein:

FIG. 6B is a cut away perspective view showing the position of the tip of the switch rod in relation to the lip of the mascara container tube cap when the device is ON.

SUMMARY OF THE INVENTION

Figure 1:
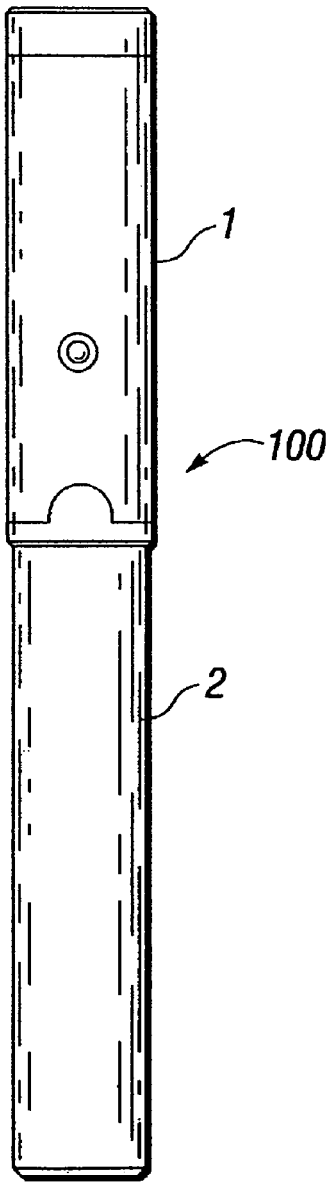
FIG. 1 is a front assembled view of a heated mascara applicator device.

This invention relates to a heated mascara applicator device also referred to herein as heated mascara. The heated mascara includes a mascara container having a tube cap with a tapered tip, the tip inserting into an upper end of the mascara container. The mascara container houses the mascara formulation also simply referred to herein as mascara. To cut cost, it is recommended to use a replaceable or a reusable mascara container. The mascara container usually engages with a mascara applicator by a screw or snap closure mechanism. The mascara applicator has a tubular shell housing a heating system including a power source and a printed circuit board having a connector terminal, a positive terminal and a negative terminal, an automatic switching system having a spring actuated switch with a projecting lever that slides a metal plate on one direction to connect two terminals inside the spring actuated switch to close the circuit and turn the heating system ON or slides the metal plate to another direction, not closing the circuit, to turn the heating system OFF. The printed circuit board is fixed into place in this example by a lock ring. The tubular shell is capped at one end and covered by a terminal connector at another end. The terminal connector has a hollow rod extension extending centrally from the end covering the tubular shell. The hollow rod extension accommodates the control heated applicator head which is used for applying the mascara. A hollow brass tube is placed at a central hollow channel inside the applicator head. The hollow brass tube has at its interior, a heating coil connecting to a PCB (printed circuit board) Rod having an electrical conducting material connecting to the positive and negative terminals by a rod terminal having two plates, one positively charged and the other, negatively charged, the positively charged plate of the rod terminal connecting to a positively charged plate of a connector terminal, the negatively charged plate of the rod terminal connecting to a negatively charged plate of the connector terminal. The heating system heats the heating coil inside the brass tube when the mascara applicator is disengaged from the mascara container and the heating is turned OFF when the mascara applicator is engaged with the mascara container. The terminal connector in this example is hollow with one end open and the other end closed except to allow a PCB Rod to protrude from the hollow rod extension. The projecting lever of the spring actuated switch is inserted in a side opening of a switch rod held by a switch rod guide positioned at a locking part of the printed circuit board. The tip of the switch rod press on a peripheral lip of the tube cap of the mascara container when the mascara applicator engages with the mascara container thereby pushing the projecting lever upwards which compresses a spring inside the spring actuated switch to put the heating OFF. The tip of the switch rod is freed from the mascara container when the mascara applicator disengages with the mascara container. This causes the spring inside the spring actuated switch to relax thereby pushing the projecting lever downwards to put the heating ON. The heat on the applicator head is controlled at about 60 degree centigrade by using a 1.5 volt battery as the power source. It is recommended to have a lamp that turns ON when the heating is ON and turns OFF when the heating is OFF. The cap covering the tubular shell has a positive terminal fixed at a top interior wall of the cap which engages with the positive terminal of the power source when the cap closes the tubular shell.

The applicator head of the device comprises two sets of lined tooth protruding from a casing of the applicator head, a first set of a single combing toothed strip and a second set of a plurality of lined applicator toothed strips located approximately 120 degrees (β) from each side of the combing toothed strip, the second set of lined applicator toothed strips separated from each other by 30 degrees (α). The protruding lined tooth comprises several cone shaped projections, approximately 2-3 millimeters in height and having a base diameter of approximately 0.25 to 0.5 millimeters, the cone shaped projection tapering into an apex with a rounded tip. The first set of combing toothed strip is a concave-shaped lined toothed strip and the second set of applicator toothed strips are convex-shaped lined toothed strips. The projections of the second set of lined applicator toothed strips can be linearly aligned resulting in the second set having parallel lined projections or the cone shaped projections of one lined applicator toothed strip can alternate in position relative to the other lined applicator toothed strip resulting in the second set having alternating projections. While the projections are recommended here to be cone shaped, similar shapes can be used. A combing strip separated from an applicator strip but in the same applicator head is within the scope of this invention.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

DETAILED DESCRIPTION OF THE INVENTION

The detailed description represented herein is not intended to represent the only way or the only embodiment in which the claimed invention may be practiced. The description herein is provided merely as an example or examples or illustrations of the claimed invention and should not be construed as the only way or as preferred or advantageous over other embodiments or means of practicing the invention. A heated mascara wherein the heater is turned ON to heat the mascara applicator head when the mascara applicator is disengaged from the mascara container and turned OFF when the mascara applicator is engaged with the mascara container as described herein is within the scope of this invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to avoid obscuring the main concepts of the invention.

The use of the terms "comprise", "comprises", "comprising" and the like means that a collection of objects or parts is not limited to those objects or parts specifically recited.

Figure 1A:
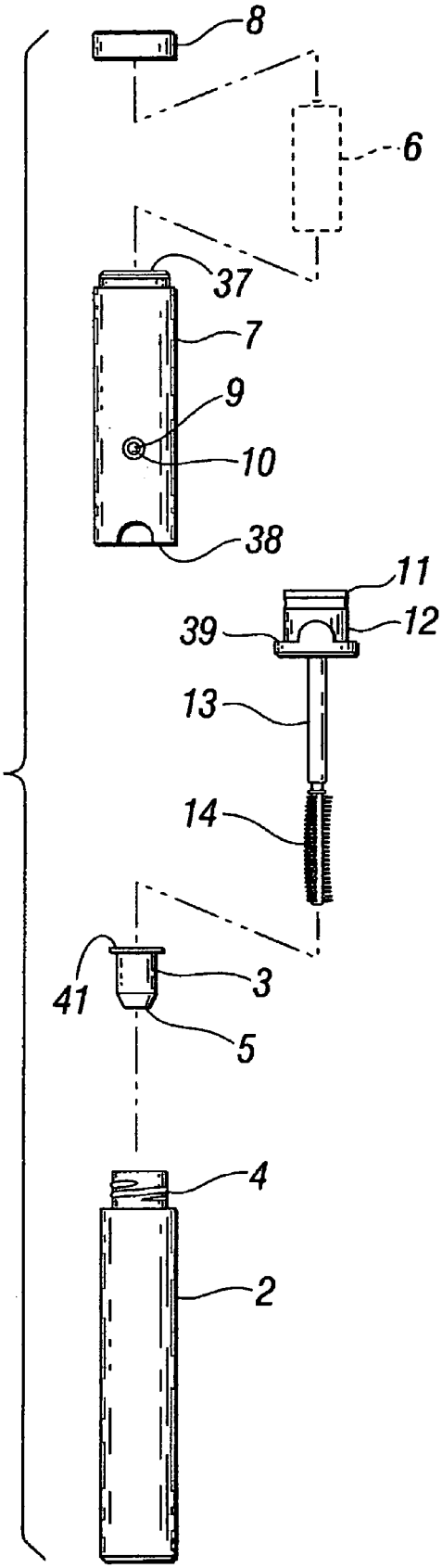
FIG. 1A is an exploded view of the heated mascara applicator device shown in FIG. 1.

FIG. 1 shows a front view of an assembled heated mascara applicator device 100 and FIG. 1A shows the components of the heated mascara applicator device. The device 100 has a mascara applicator 1 and a mascara container 2. The mascara formulation is housed or contained inside the mascara container 2. A tube cap 3 akin to a washer is placed at the interior upper end 4 of the container 2. The tube cap has a tapered tip 5 at the end inserting into the container 2 as shown in FIG. 1A. The tapered tip removes excess mascara on the applicator head as it is removed from the container to apply on the eyelashes. The mascara container can be replaceable or reusable to minimize the cost incurred by the heating system installed inside the mascara applicator 1. In a replaceable mascara, when the mascara formulation inside the mascara container is used up, one simply throws the mascara container away and replaces it with a new one. A reusable mascara container will even cut the cost further. A reusable mascara container has a removable reservoir which is either disposable or reusable. A separate application, Ser. No. 12/072667, has been filed on a reusable mascara container identified and described in that application as mascara holder or shell having a removable reservoir which is hereby incorporated by reference. For usage with this application, the reusable mascara container here will not have the removable and replaceable mascara applicator since herein, the mascara applicator 1 is not designed to have a removable or reusable applicator head. This invention is focused on a new mascara applicator 1 that can be used with a replaceable or reusable mascara container.

The mascara applicator 1 comprises a battery or a power source 6 inside a compartment of a tubular shell 7 having an optional opening 9 for a lamp 10. A cap 8 closes one end of the tubular shell. One end 11 of a terminal connector 12 inserts into the tubular shell 7 and covers the other end of the tubular shell. The terminal connector 12 has a hollow rod extension 13 extending centrally from the end 11 which accommodates an applicator head 14. The terminal connector 12 is also hollow with one end open and the other end plugging the tubular shell closed except to allow the printed circuit board (PCB) Rod 21 to protrude from the hollow rod extension 13 of the terminal connector as shown in FIG. 2.

Figure 7:
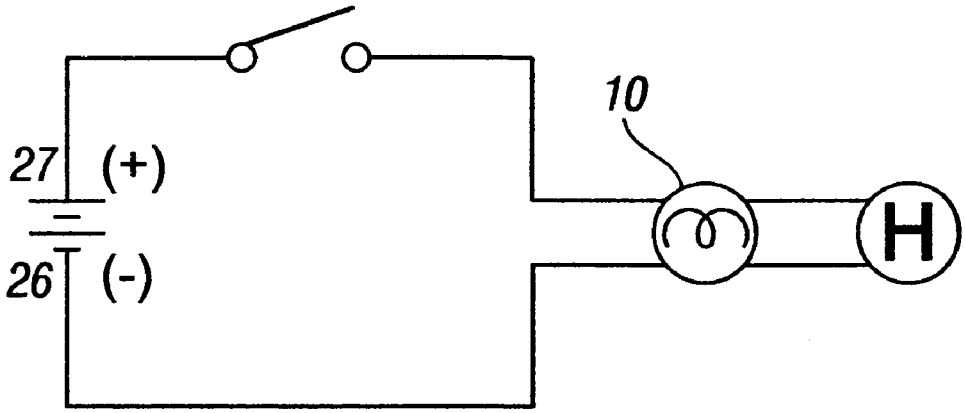
FIG. 7 is a circuit diagram of the heating system.

The device is uniquely designed with a new heating system which enables the eyelashes to be curled at the same time as the mascara is being applied. The device is installed with an automatic switching system 15 (spring actuated switch, switch rod and switch rod guide) which turns the heating system ON when the applicator 1 is disengaged from the mascara container 2, that is, the applicator is pulled out of the mascara container, and turns the system OFF when the mascara applicator 1 is engaged with the mascara container 2 which closes the device 100. The automatic switching system comprises a spring actuated switch 25 having a projecting lever 16 that slides a metal plate, connecting two terminals inside the switch which closes the circuit as shown in FIG. 7 and turns the heater ON. The spring actuated switch is commercially available as Slide Switch from Daejin Industry Co., Ltd., part number DJS-1270 H, www.djswitch.co.kr., 164-2, Chunui-Dong, Wonmi-Gu, Buchon City, Kyunggi-Do, Korea.

The components making up the heating system will be described from one end proximal to the applicator head 14 to the other end where the cap 8 is located.

Figure 2:
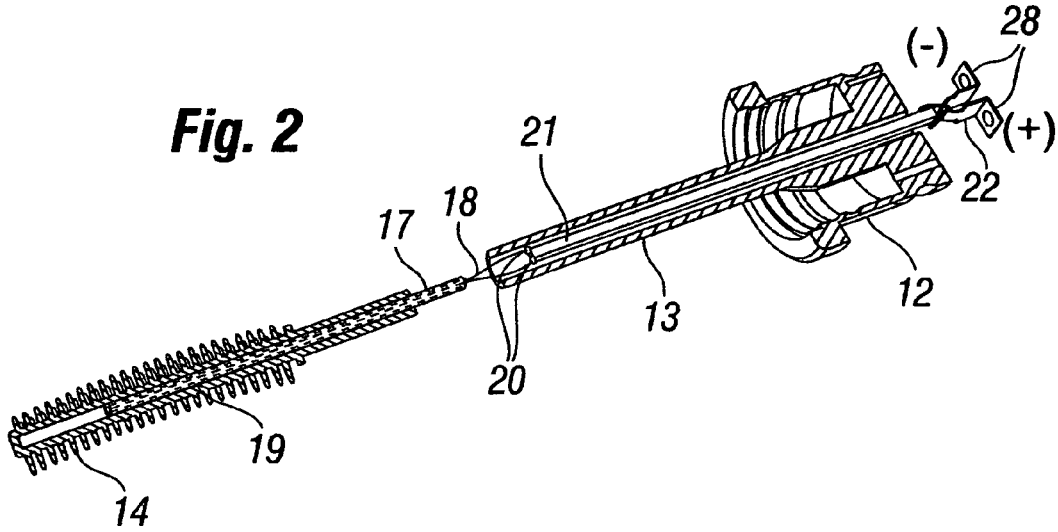
FIG. 2 is a cross sectional view of the applicator head connected to the terminal connector.
Figure 3:
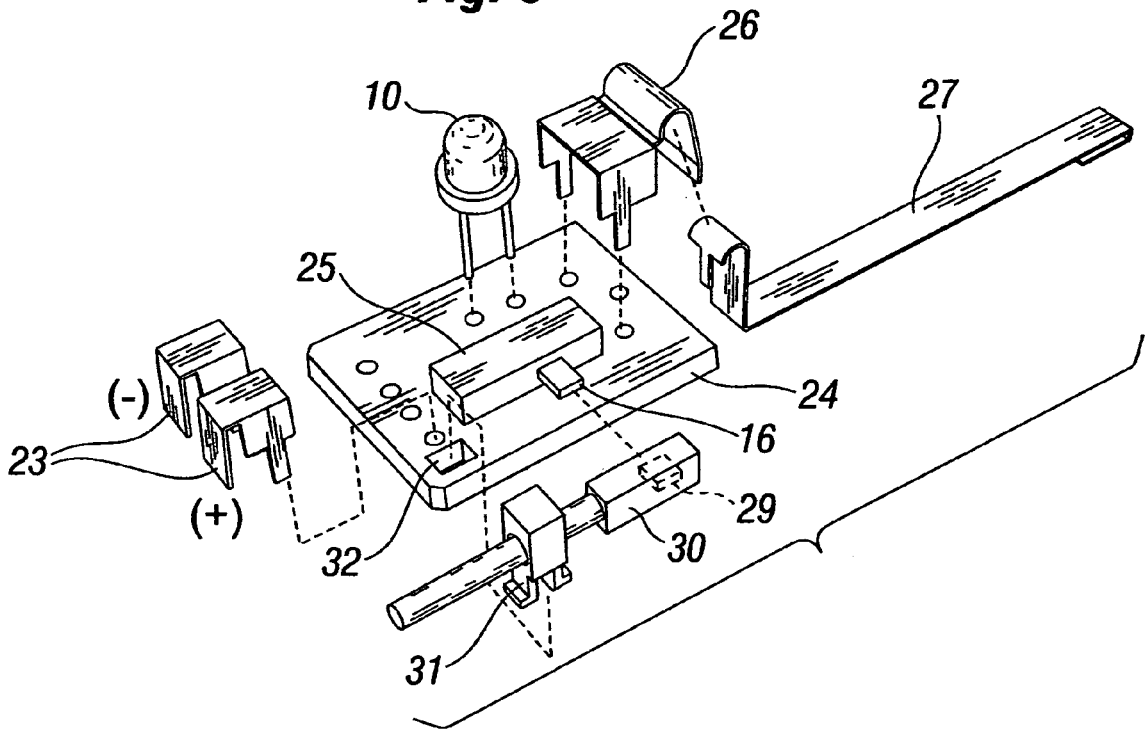
FIG. 3 is an exploded view of the components of the heating system attached to the printed circuit board.
Figure 4:
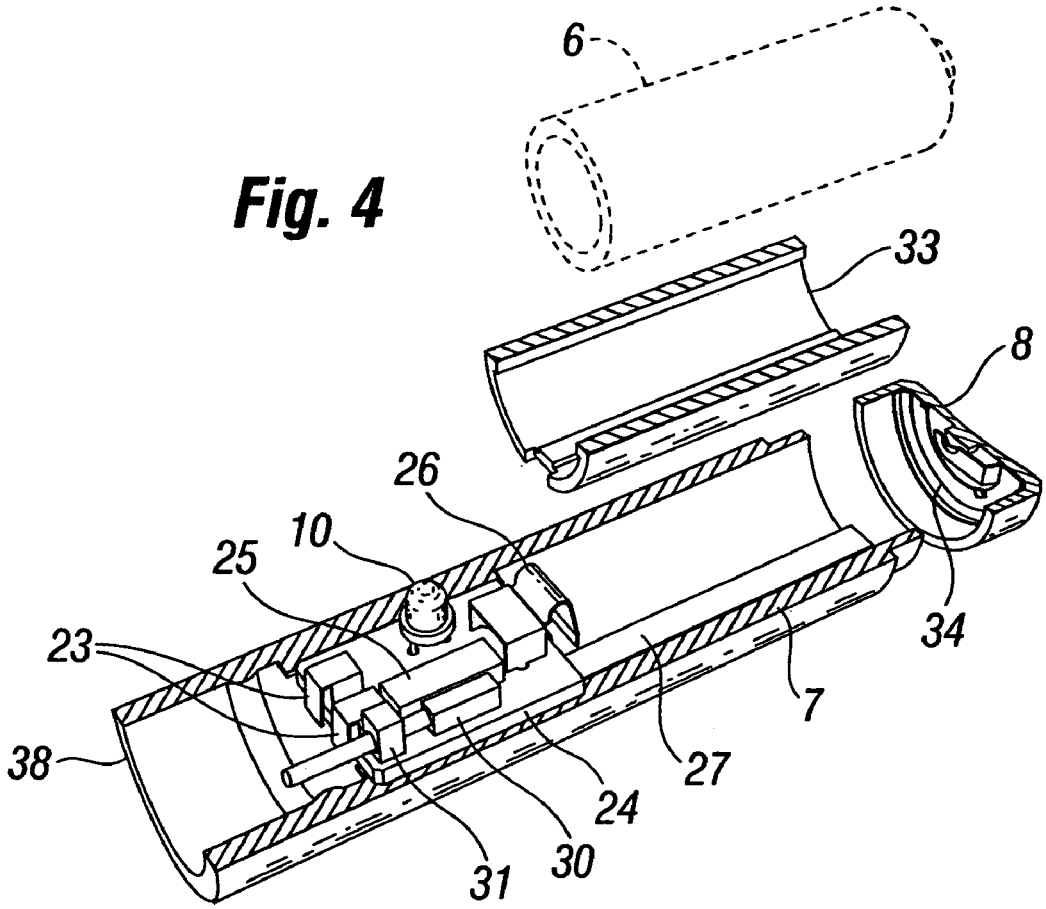
FIG. 4 is a cross sectional view of the tubular shell and the cap showing components of the heating system and how the battery and the cap connects to the tubular shell.

As shown in FIG. 2, a hollow brass tube 17 which has a heating coil 18 at its interior is placed inside the applicator head 14 which also has a central hollow channel 19 for accommodating the brass tube 17. The protruding end 20 of the heating coil 18 is soldered to a printed control board rod, hereinafter referred to as PCB rod 21 which can be a brass coated or brass lined epoxy or an equivalent electrical conducting material. This PCB rod 21 is inserted inside the terminal connector 12 through the hollow rod extension 13 and the end opposite the end soldered with the coil is connected to a rod terminal 22. The rod terminal has two laterally directed plates 28, one positively charged and the other, negatively charged as shown in FIG. 2. The rod terminal 22 is connected to a connector terminal 23 which is soldered to the printed circuit board (PCB) 24 along with a spring actuated switch 25, lamp 10, negative terminal 26, and the positive terminal 27. The connector terminal 23 are shown as two plates, one positively charged and the other, negatively charged. The positive plate connects to the positive plate of the rod terminal 22 and the negative plate connects to the negative plate of the rod terminal. The projecting lever 16 of the spring actuated switch 25 is inserted in a side opening 29 on the switch rod 30 which is held by a switch rod guide 31 positioned at the locking part 32 of the PCB 24. After the PCB 24 with all the other components of the heating system are assembled, this is placed at the interior compartment of the tubular shell 7 and is fixed into place by a lock ring 33. The battery 6 as the power source used in this illustration is placed on the lock ring 33. FIG. 3 shows these components of the heating system in an unassembled form while FIG. 4 shows the above components in an assembled form inside the tubular shell 7 with the lock ring, battery and cap unassembled to show the relationship of the positive and negative terminals to the battery and cap.

Figure 1B:
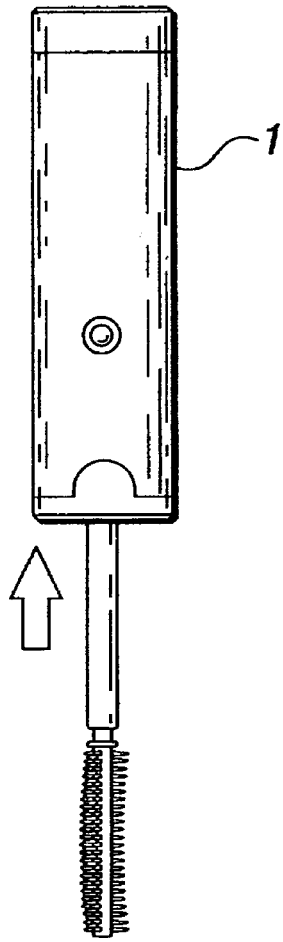
FIG. 1B is a front view of the mascara applicator.
Figure 5:
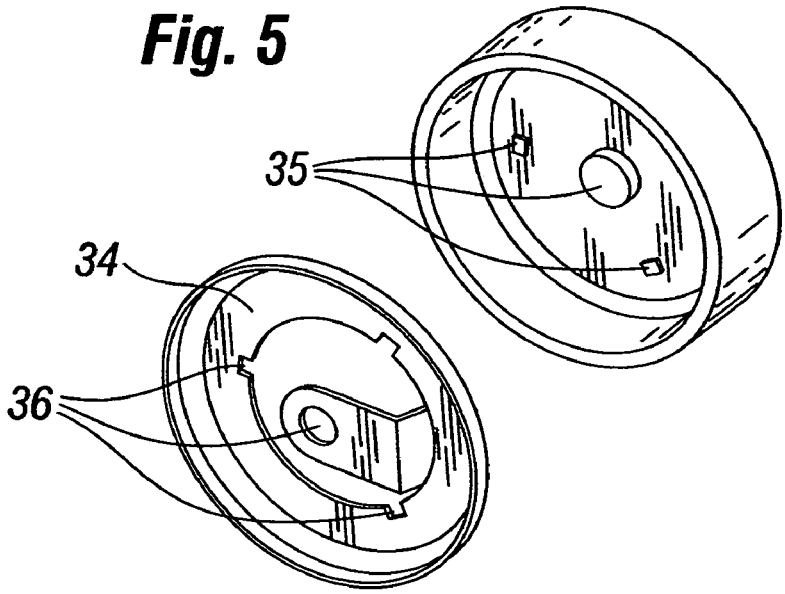
FIG. 5 is a perspective view showing the internal top wall of the cap and how a positive terminal can be fixedly attached to it.

The battery is introduced inside the lock ring 33 at one end of the tubular shell 7 and is covered by a cap 8 which has in its interior, a positive terminal 34. The top interior wall of cap 8 has protruding parts 35 that matches with grooves or openings 36 on the positive terminal 34 to lock or fix the positive terminal 34 in place after it is inserted into the cap as shown in FIGS. 4 and 5. Other means of attaching a positive terminal on the interior of a cap will do as well. The positive terminal 34 engages with the positive terminal of the power source, battery 6, when the cap 8 closes the tubular shell 7 at one end 37. The other end 38 of the tubular shell rests on a protruding lip 39 of the terminal connector 12. FIG. 1B shows the mascara applicator 1 isolated from the mascara container 2.

Figure 6A:
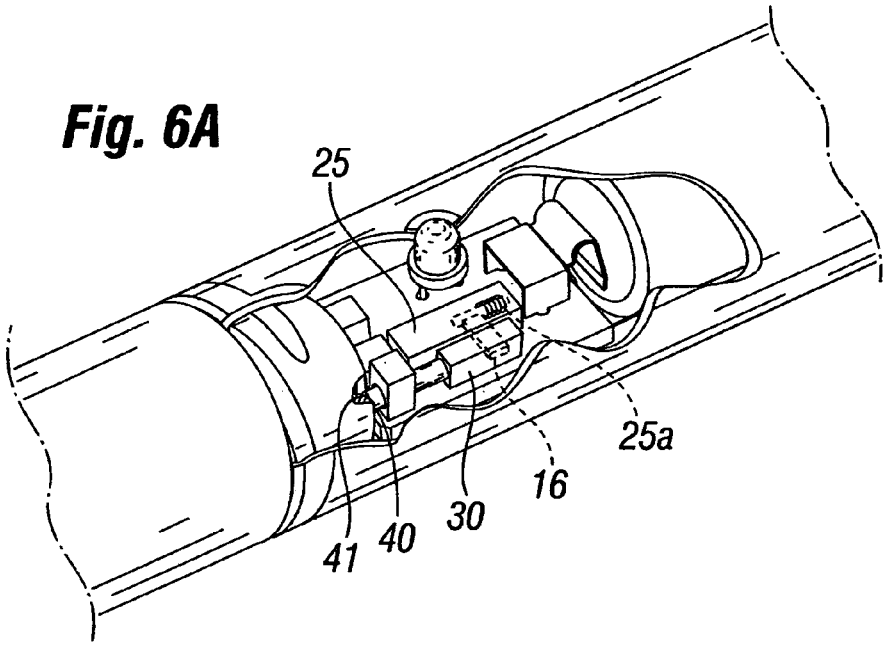
FIG. 6A is a cut away perspective view showing the position of the tip of the switch rod in relation to the lip of the mascara container tube cap when the device is OFF.
Figure 6B:
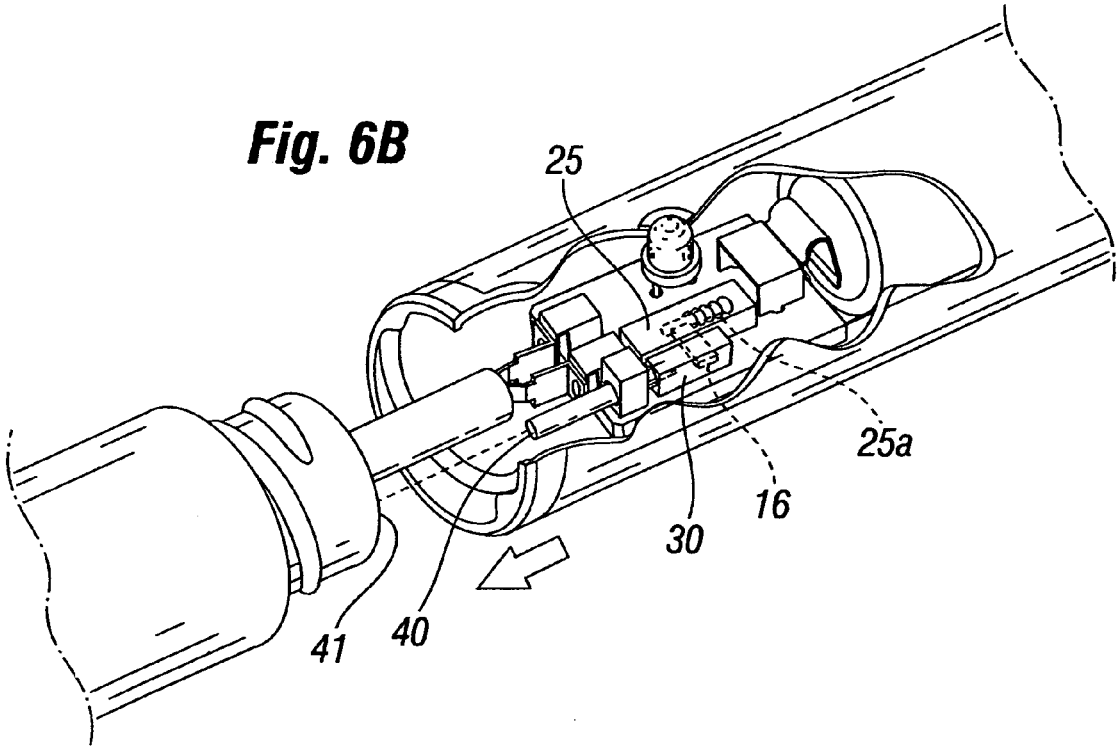

When not in use, the mascara applicator 1 is engaged with the mascara container 2 as shown in FIG. 1. Current applicators 1 are engaged with the mascara container 2 by a screw or snap closure mechanism. The heating system is in the OFF position when the applicator 1 is engaged with the container 2. At this closed position, the tip 40 of the switch rod 30 presses on the peripheral outside surface 41, lip of the tube cap 3, as shown in FIG. 6A. When the tip 40 presses on the lip 41 of the tube cap 3 of the mascara container, the projecting lever 16 of the spring actuated switch 25 which is inside the switch rod 30 is pushed up, thereby causing the spring 25*a* inside the spring actuated switch to compress. At this position, a sliding metal plate (not shown) connected to the projecting lever, will not connect the terminals inside the switch thereby not closing the circuit between the positive battery terminal and the heating element and LED or lamp 10, if present, keeping the heater OFF. When the mascara applicator is ready for use, the applicator 1 is disengaged from the container 2. The tip 40 is released from its contact with the lip 41 of the tube cap 3 of the mascara container and this disengagement causes the compressed spring inside the spring actuated switch 25 to relax thereby pushing the projecting lever down as shown in FIG. 6B. When the projecting lever 16 moves down, it carries with it the sliding metal plate which at this position, now makes a contact and connects the terminals inside the spring actuated switch and closes the circuit and turn the heater ON. A lamp 10, if present, also lights up when the heat is turned ON to apprise the user. The circuit diagram with a lamp 10 is shown in FIG. 7. To keep the applicator head from burning the eyelashes and the user, the temperature on the coil inside the brass tubing is controlled by using a 1.5 volt battery which heats the brass tube at about 66 degrees centigrade (66° C.) and the applicator head at about 60° C.

Figure 8:
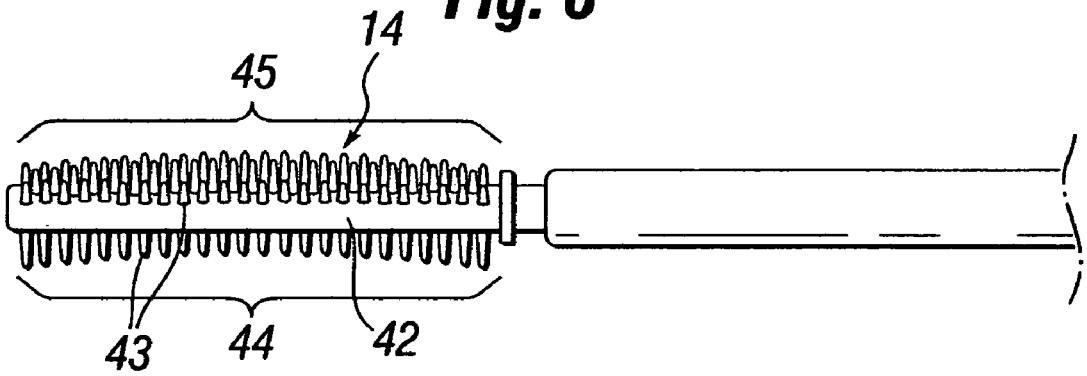
FIG. 8 is a perspective view of the applicator head.
Figure 8A:
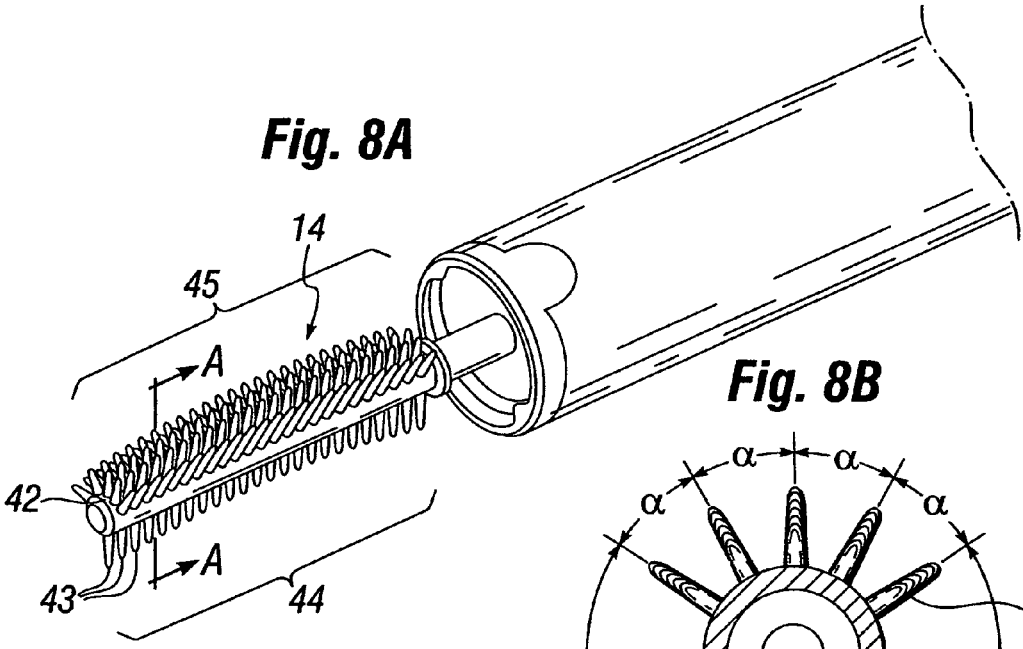
FIG. 8A is a perspective view showing the projections on the applicator head lined up in parallel lines.
Figure 8B:
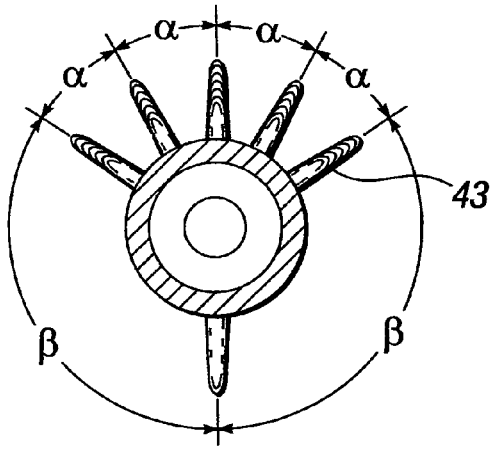
FIG. 8B is a cross sectional view of the applicator head taken along A-A of FIG. 8A.
Figure 8C:
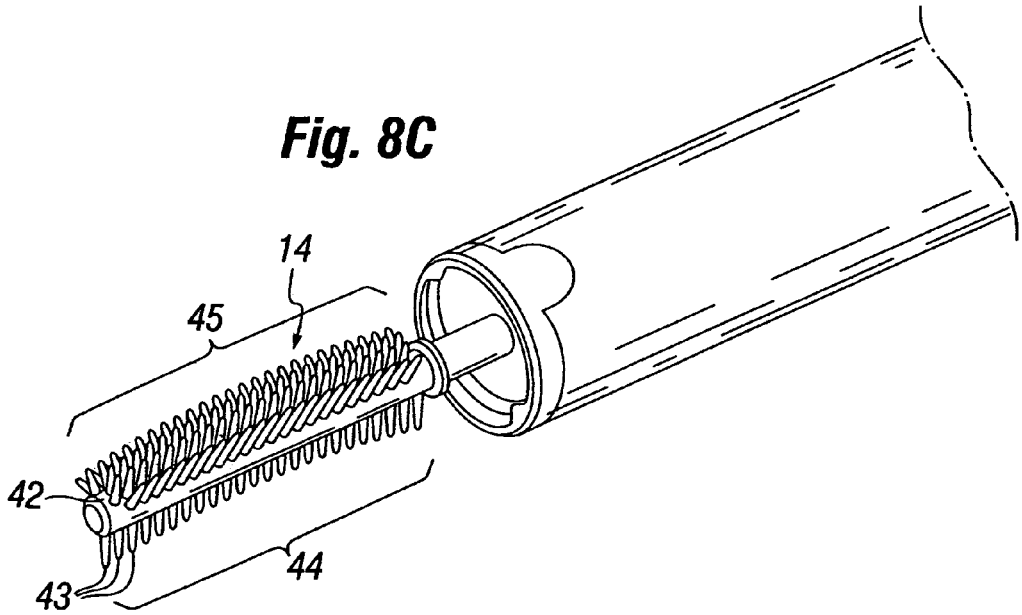
FIG. 8C is a perspective view showing the projections on the applicator head lined up in alternate positions.

Another unique feature is the design of the applicator head 14. As stated above, the applicator head is heated when the mascara applicator 1 is in use. The heat comes from the heated brass tube 17 housing a heating coil 18 introduced at the interior central hollow channel 19 of the applicator head 14 having a casing 42 with protruding lined brushes or projections 43 at its surface. The protrusions or projections from the surface of the casing of the applicator head are of two sets. The first set is a combing toothed strip 44 made of plastic such as thermoplastic elastomers. This set is arranged in a single line and is located approximately 120 degrees ($\beta$) on both sides from a second set made up of more than one lined toothed strip, herein as example, a five (5) lined toothed strip 45, which are approximately 30 degrees ($\alpha$) apart from each other as shown in FIGS. 8, 8A and 8B. The second set of toothed strips, herein also referred to as applicator toothed strips, are also made of the same material as the first set of combing toothed strip 44. These toothed strips are designed differently from the conventional brushes which are usually bristle-like. The combing toothed strip 44 and the applicator toothed strips 45 comprises of a number of cone shaped projections 43. The combing toothed strip 44 is used to comb the eyelashes before or after the mascara application which, in the conventional manner, is done by the use of a separate comb specifically designed for this use. Combing is usually done to separate eyelashes that have been clumped up by the mascara and also to remove excess mascara sticking on the eyelashes. The first set of strip 44 has similar dimensions as the second set of strip 45. They are approximately 2-3 millimeters in height and the diameter of the bases is approximately 0.25 to 0.5 millimeters tapering into an apex, preferably with a rounded tip to prevent the tip from scratching or hurting the tissues or skin near or adjacent to the eyelashes. As shown in FIG. 8, the first set of lined strip, the combing toothed strip 44, have a concave-shaped lined toothed strip, that is, the coned shaped projections 43 are shorter at the middle section than those at the opposite edges, the length gradually increasing from the mid section to the edge. The second set 45 is used to apply mascara. Consequently, there are more than one lined toothed strips. In this example, there are five lined toothed strips that are apart from each other by 30 degrees ($\alpha$). As opposed to the combing toothed strip 44, the cone shaped projections 43 on the second set of applicator toothed strips 45 is lined in a convex-shaped manner, taller at the middle section than those at the edges. The length of the projections gradually decreases from the mid section to the edges. The five lined application toothed strips may have projections aligned with each other as shown in FIG. 8A or they may alternate in positions relative to the other lined projections as shown in FIG. 8C. For the application strip, the number of lined toothed strips and their respective dimensions can be varied based on the performance observed and desired. If the dimensions are varied, for example, the length of the projections or the base diameter of the cone shaped projections, the number of lined strips may have to be increased or reduced. The uniqueness here lies in having a combing strip 44 located apart from the application strip 45 but at the same applicator head and on the form and shape of the projection not being bristle-like. With the availability of these two sets of strips, application and combing can be done in a single step with a single device.

While the embodiments of the present invention have been described, it should be understood that various changes, adaptations, and modifications may be made therein without departing from the spirit of the invention and the scope of the claims.

I claim:

1. A heated mascara, comprising:

a replaceable or reusable mascara container having a tube cap with a tapered tip, the tip inserting into an upper end of the mascara container housing a mascara formulation;

a mascara applicator having a tubular shell housing a heating system including an approximately 1.5 volt power source and a printed circuit board having a connector terminal, a positive terminal and a negative terminal, a spring actuated switch having a projecting lever that slides a metal plate on one direction to connect two terminals inside the spring actuated switch to close the circuit and turn the heating system ON or slides the metal plate to another direction, not closing the circuit to turn the heating system OFF, the printed circuit board fixed into place by a lock ring, the tubular shell capped at one end and covered by a terminal connector at another end, the terminal connector having a hollow rod extension extending centrally from the end covering the tubular shell, the hollow rod extension accommodating a control heated applicator head; and, a hollow brass tube placed at a central hollow channel inside the applicator head, the hollow brass tube having at its interior a heating coil connecting to a PCB rod having an electrical conducting material connecting to the positive and negative terminals by a rod terminal having two plates, one positively charged and the other, negatively charged, the positively charged plate of the rod terminal connecting to a positively charged plate of the connector terminal, the negatively charged plate of the rod terminal connecting to a negatively charged plate of the connector terminal, the heating system heating the heating coil inside the brass tube when the mascara applicator is disengaged from the mascara container and turning the heating OFF when the mascara applicator is engaged with the mascara container.

2. The heated mascara of claim 1 wherein the projecting lever of the spring actuated switch is inserted in a side opening of a switch rod held by a switch rod guide positioned at a locking part of the printed circuit board, the switch rod having a tip pressing on a peripheral lip of the tube cap of the mascara container when the mascara applicator engages with the mascara container thereby pushing the projecting lever upwards and compressing a spring inside the spring actuated switch to put the heating OFF and the tip freed from the mascara container when the mascara applicator disengages with the mascara container thereby pushing the projecting lever downwards and relaxing a spring inside the spring actuated switch to put the heating ON.

3. The heated mascara of claim 1 wherein the power source is a battery, the battery heating the applicator head at about 60 degree centigrade.

4. The heated mascara of claim 1 further comprising a lamp that turns ON when the heating is ON and turns OFF when the heating is OFF.

5. The heated mascara of claim 1 wherein the cap covering the tubular shell has a positive terminal fixed at a top interior wall of the cap, the positive terminal engaging with a positive terminal of the power source when the cap closes the tubular shell.

6. A heated mascara, comprising:

a mascara container housing a mascara formulation, the mascara container having a tube cap with a tapered tip, the tip inserting into an upper end of the mascara container;

a mascara applicator having an applicator head control heated by a heating system comprising a heating coil inside a hollow brass tubing placed at a central channel inside the applicator head, the heating system turning on when the mascara applicator is disengaged from the mascara container and turning off when the mascara applicator is engaged with the mascara container; and, two sets of lined tooth protruding from a casing of the applicator head, a first set of a single combing toothed strip and a second set of a plurality of lined applicator toothed strips located approximately 120 degrees from each side of the combing toothed strip, the second set of lined applicator toothed strips separated from each other by approximately 30 degrees on the applicator head.

7. The heated mascara of claim 6 wherein the set of protruding lined tooth are a plurality of cone shaped projections, approximately 2-3 millimeters in height and having a base diameter of approximately 0.25 to 0.5 millimeters, the cone shaped projection tapering into an apex with a rounded tip.

8. The heated mascara of claim 6 wherein the first set of combing toothed strip is a concave-shaped lined toothed strip and the second set of applicator toothed strips are convex-shaped lined toothed strips.

9. The heated mascara of claim 6 wherein the cone shaped projections of the second set of lined applicator toothed strips are linearly aligned resulting in the second set having parallel lined projections or the cone shaped projections of one lined applicator toothed strip alternate in position relative to the other lined applicator toothed strip resulting in the second set having alternating projections.

10. A heated mascara, comprising:

a mascara container housing a mascara formulation, the mascara container having a tube cap with a tapered tip, the tip inserting into an upper end of the mascara container; and, a mascara applicator having an applicator head control heated by a heating system comprising a heating coil inside a hollow brass tubing placed at a central channel inside the applicator head, the heating coil connected to a positive and negative terminal and a spring actuated system having a spring actuated switch with a projecting lever inserted in a switch rod, the switch rod having a tip pressing on a peripheral lip of the tube cap of the mascara container when the mascara applicator engages with the mascara container and pushing the projecting lever upwards to compress a spring and slide a metal plate in the spring actuated switch on one direction to keep the positive and negative terminals of the heating coil from closing a circuit with a power source and keep the heating OFF when the mascara applicator is not in use and the tip freed to turn the heating ON when the mascara applicator disengages from the mascara container causing the spring inside the spring actuated switch to relax and push the projecting lever downwards to slide the metal plate on another direction to close the circuit between the terminals of the heating coil and the power source when the mascara applicator is in use.

11. The heated mascara of claim 10 wherein the mascara applicator has a tubular shell housing the power source and a printed circuit board having a connector terminal, the positive terminal and the negative terminal, and the spring actuated switch, the tubular shell capped at one end and covered by a terminal connector at another end, the terminal connector having a hollow rod extension extending centrally from the end covering the tubular shell, the hollow rod extension accommodating the applicator head, the cap covering the tubular shell having a positive terminal fixed at a top interior wall of the cap, the positive terminal engaging with a positive terminal of the power source when the cap closes the tubular shell.

12. The heated mascara of claim 11 wherein the terminal connector is hollow with one end open and the other end closed except to allow a PCB Rod to protrude from the hollow rod extension.

13. The heated mascara of claim 10 wherein the hollow brass tubing having the heating coil at its interior connects to a PCB rod having an electrical conducting material connecting to a positive and a negative terminal by a rod terminal having two plates, one positively charged and the other, negatively charged, the positively charged plate of the rod terminal connecting to a positively charged plate of a connector terminal, the negatively charged plate of the rod terminal connecting to a negatively charged plate of the connector terminal, the connector terminal located on a printed circuit board having the spring actuated switch.

14. The heated mascara of claim 10 wherein the projecting lever of the spring actuated switch is inserted in a side opening of the switch rod held by a switch rod guide positioned at a locking part of a printed circuit board, the switch rod having the tip pressing or releasing from the peripheral lip of the tube cap of the mascara container.

15. The heated mascara of claim 10 wherein the heat is controlled by a 1.5 volt battery as power source, the battery heating the applicator head at about 60 degree centigrade.

16. The heated mascara of claim 10 wherein the mascara container is replaceable or reusable.

17. The heated mascara of claim 10 further comprising a lamp that turns ON when the heating is ON and turns OFF when the heating is OFF.

18. The heated mascara of claim 10 wherein the applicator head comprises two sets of lined tooth protruding from a casing of the applicator head, a first set of a single combing toothed strip and a second set of a plurality of lined applicator toothed strips located approximately 120 degrees from each side of the combing toothed strip, the second set of lined applicator toothed strips separated from each other by 30 degrees.

19. The heated mascara of claim 18 wherein the set of protruding lined tooth are a plurality of cone shaped projections, approximately 2-3 millimeters in height and having a base diameter of approximately 0.25 to 0.5 millimeters, the cone shaped projections tapering into an apex with a rounded tip.

20. The heated mascara of claim 19 wherein the cone shaped projections of the second set of lined applicator toothed strips are linearly aligned resulting in the second set having parallel lined projections or the cone shaped projections of one lined applicator toothed strip alternate in position relative to another lined applicator toothed strip resulting in the second set having alternating projections.

21. The heated mascara of claim 18 wherein the first set of combing toothed strip is a concave-shaped lined toothed strip and the second set of applicator toothed strips are convex-shaped lined toothed strips.

* * * * *